US007032411B2

(12) United States Patent
Hebert

(10) Patent No.: US 7,032,411 B2
(45) Date of Patent: Apr. 25, 2006

(54) INTEGRATED DUAL CIRCUIT EVAPORATOR

(75) Inventor: Thomas H. Hebert, Odessa, FL (US)

(73) Assignee: Global Energy Group, Inc., Plano, TX (US)

( * ) Notice: Subject to any disclaimer, the term of this patent is extended or adjusted under 35 U.S.C. 154(b) by 6 days.

(21) Appl. No.: 10/647,898

(22) Filed: Aug. 25, 2003

(65) Prior Publication Data

US 2004/0118151 A1 Jun. 24, 2004

Related U.S. Application Data

(60) Provisional application No. 60/405,771, filed on Aug. 23, 2002.

(51) Int. Cl.
*F25B 39/02* (2006.01)

(52) U.S. Cl. ..... 62/525; 62/510; 62/515

(58) Field of Classification Search ..... 62/238.7, 62/515, 524–526, 504, 510
See application file for complete search history.

(56) References Cited

U.S. PATENT DOCUMENTS

| | | | | | |
|---|---|---|---|---|---|
| 3,866,439 | A | * | 2/1975 | Bussjager et al. | 62/504 |
| 4,040,268 | A | * | 8/1977 | Howard | 62/335 |
| 4,201,065 | A | * | 5/1980 | Griffin | 62/510 |
| 4,712,612 | A | * | 12/1987 | Okamoto et al. | 165/146 |
| 6,109,044 | A | * | 8/2000 | Porter et al. | 62/96 |
| 6,116,048 | A | | 9/2000 | Hebert | 65/525 |

* cited by examiner

*Primary Examiner*—Melvin Jones
(74) *Attorney, Agent, or Firm*—Burr & Brown

(57) ABSTRACT

An evaporator system comprised of two individual refrigerant circuits, integrated in such a way that if one circuit is not in operation, no portion of the airflow through the evaporator fails to come into contact with the refrigerant in the active circuit. This eliminates the possibility of so-called bypass air (air passing through inactive region of evaporator). An extreme example of bypass air is illustrated in the use of a split face evaporator where on half of the evaporator is active and the other half is inactive. The purpose of such an integrated dual circuit evaporator being to improve part load performance of a refrigerating or air conditioning system when one circuit of the system is inactive.

6 Claims, 18 Drawing Sheets

INTEGRATED DUAL CIRCUIT EVAPORATOR

CROSS-REFERENCE TO RELATED APPLICATIONS

This invention claims priority of provisional application No. 60/405,771, filed Aug. 23, 2002, the disclosure of which is incorporated by reference herein.

BACKGROUND OF THE INVENTION

1. Field of the Invention

This invention relates to a two circuit evaporator system of increased refrigeration capacity and increased dehumidification capacity, especially when one circuit is inactive, for use with any two circuit air conditioner, refrigeration or heat pump system. This invention more particularly pertains to an apparatus and method comprising a two circuit evaporator system that allows for integration of the two circuits in such a way as to eliminate any possibility of any portion of the air passing through the face of the evaporator, when one circuit is inactive, not coming into contact with some portion of the active circuit. Further, this invention incorporates the principles of increasingly colder refrigerant temperatures counter flow to the direction of the incoming air supply as illustrated in U.S. Pat. No. 6,116,048, the disclosure of which is incorporated by reference herein.

2. Description of the Background Art

Presently, there exist many types of devices designed to operate in the thermal transfer cycle. The vapor-compression refrigeration cycle is the pattern for the great majority of commercially available refrigeration systems. This thermal transfer cycle is customarily accomplished by a compressor, condenser, throttling device and evaporator connected in serial fluid communication with one another. The system is charged with refrigerant, which circulates through each of the components. More particularly, the refrigerant of the system circulates through each of the components to remove heat from the evaporator and transfer the heat to the condenser. The compressor compresses the refrigerant from a low-pressure superheated vapor state to a high pressure superheated vapor thereby increasing the temperature, enthalpy and pressure of the refrigerant. A superheated vapor is a vapor that has been heated above its boiling point temperature. It then leaves the compressor and enters the condenser as a vapor at some elevated pressure where the refrigerant is condensed as a result of heat transfer to cooling water and/or ambient air. The refrigerant then flows through the condenser condensing the refrigerant at a substantially constant pressure to a saturated-liquid state. The refrigerant then leaves the condenser as a high pressure liquid. The pressure of the liquid is decreased as it flows through the expansion valve causing the refrigerant to change to a mixed liquid-vapor state. The remaining liquid, now at low pressure, is vaporized in the evaporator as a result of heat transfer from the refrigerated space. This vapor then enters the compressor to complete the cycle. The ideal cycle and hardware schematic for vapor-compression cycle refrigeration is shown in FIG. 1 as cycle 1-2-3-4-1. More particularly, the process representation in FIG. 1 is represented by a pressure-enthalpy diagram, which illustrates the particular thermodynamic characteristics of a typical refrigerant. The P-h plane is particularly useful in showing amounts of energy transfer as heat. Referring to FIG. 1, saturated vapor at low pressure enters the compressor and undergoes a reversible adiabatic compression, 1-2. Adiabatic refers to any change in which there is no gain or loss of heat. Heat is then rejected at constant pressure in process 2-3, and the working fluid is then evaporated at constant pressure, process 4-1, to complete the cycle. However, the actual refrigeration cycle may deviate from the ideal cycle primarily because of pressure drops associated with fluid flow and heat transfer to or from the surroundings.

It is readily apparent that the evaporator plays an important role in removing the heat from the thermal cycle. Evaporators convert a liquid to a vapor by the addition of latent heat. Latent heat is the amount of heat absorbed or evolved by one mole, or a unit mass, of a substance during a change of state such as vaporization at constant temperature and pressure. Most commercially available evaporators have a coil of a tubular body extending within the evaporator for the purpose of providing a heat exchange surface. In a two circuit evaporator, the coils of such evaporators are currently one of two primary types, both with serpentine rows of tubing extending through the evaporators with currently no apparent concern about refrigerant temperature being colder counter flow to the incoming direction of the air supply. Type one is the split face coil design in which one circuit occupies a percentage based on percentage of total capacity for the circuit, of the overall face area of the evaporator, and the other circuit occupying the remaining percentage of the overall face area. When one circuit is inactive, the air passing through the inactive circuit acts like bypass air and no cooling to this fraction of the circulated air is accomplished and the blower motor power for this portion of the air supply is virtually wasted.

The second type of two circuit evaporator is known as an alternating circuit evaporator where each circuit has multiple inlet and outlet points that alternate with multiple inlet and outlet points of the other circuit. This is more efficient and effective than the split face evaporator but still produces a bypass air effect one each of the alternating portions of an inactive circuit.

By integrating the alternating circuits, the bypass air effect can be minimized if not totally eliminated. Coupled with the principle of counter flow heat exchange as illustrated by U.S. Pat. No. 6,116,048, the effectiveness in capacity per evaporator surface area and dehumidification improvements will be greatly enhanced for two circuit evaporators versus any of the known embodiments of the evaporator art.

In response to those realized inadequacies of earlier configurations of two circuit evaporators used within the thermal transfer cycle of two circuit air conditioner, refrigeration equipment and heat pumps, and their resulting inefficiencies, it became clear that there is a need for integrated counter flow dual circuit evaporator designs that would take advantage of the known benefits of fluid to fluid counter flow heat exchange and the known benefits of elimination of bypass air. The results of the use of these new evaporator designs being greater refrigeration capacity and improved dehumidification, especially in part load application where one circuit is inactive, where the benefits are realized at no additional power consumption for the total refrigeration thermal cycle.

The greater capacity being realized from the higher mass flow of refrigerant through the evaporator is due to improved heat exchange brought about by elimination of the bypass air regions as well as counter flow principles and greater dehumidification brought about by the entire coil being colder than the dew point temperature because of the same reasons as above. Inasmuch as the art consists of various types of two circuit evaporators and associated thermal transfer cycle configurations, it can be appreciated that there is a continuing need for and interest in improvements to two circuit evaporators and their configurations, and in this respect, the present invention addresses these needs and interests.

Therefore, it is an object of this invention to provide an improvement which overcomes the aforementioned inadequacies of the prior art devices and provides an improvement which is a significant contribution to the advancement of the two circuit evaporator art.

Another object of this invention is to provide new and improved integrated dual circuit evaporator which has all the advantages and none of the disadvantages of the earlier two circuit evaporators in a thermal transfer cycle.

Still another objective of the present invention is improved thermodynamic efficiency.

Yet another objective of the present invention is to provide elements of circuit integration and counter flow principles to all possible variations of types and purposes of evaporators, including those with minimum sub-cooling, maximum sub-cooling, minimal superheat, maximum superheat, low pressure gradients, high pressure gradients, low "glide" temperature spreads, high "glide" temperatures spreads, as well as for: flat coils, slant coils or "A" coils, and for: down-flow or up-flow designs. The purpose for each design being to eliminate bypass air when one circuit of a two circuit evaporator is inactive and to put the warmest part(s) of the evaporator upstream in the air flow from the coldest part(s) of the evaporator.

Still a further objective of the present invention is to provide increased refrigeration capacity.

Yet a further objective is to allow for increased latent heat removal and, therefore, increased dehumidification.

An additional objective is to provide an evaporator that is highly reliable in use.

Another objective of the invention is to provide an evaporation system having an increased energy efficiency ratio (EER) as a result of a decrease in wattage input and an increase in refrigeration capacity.

Even yet another objective of the invention is to provide two circuit evaporators where the two circuits are integrated to prevent bypass air when one circuit is inactive and where both circuits comprise in combination two or more sections of each evaporator circuit positioned in the air stream so that the warmest section(s) of each evaporator circuit is (are) upstream of the coldest section(s) of each evaporator circuit is pre-cooled before coming into contact with the colder downstream section(s) of e4ach evaporator circuit.

Another objective of the present invention is to provide a method for enhancing latent heat removal in a thermal transfer cycle by cooling the air to temperatures even lower than standard evaporators so that the air is substantially below the dew point temperature of the air. By increasing the temperature difference below the dew point temperature, more humidity is removed and the latent capacity percentage of the total heat removal is increased.

Yet another objective of the present invention is to provide a method for increasing the superheat capacity of a refrigerant in a thermal transfer cycle. This increases the total change in enthalpy of the refrigerant per unit mass flow and thereby increases overall capacity. This is accomplished by putting the warmer superheat region of the evaporator upstream in the air supply from the colder region(s) thereby supplying more heat to this superheat region.

Even yet another objective of the present invention is to provide an apparatus and method that will increase overall refrigerant mass flow thereby increasing refrigerant capacity while doing so in a more efficient manner.

And yet another objective of the present invention is to provide a method and apparatus that will improve the load performance of a two circuit evaporator when one circuit is inactive, whereby capacity, dehumidification, and mass flow are all greatly improved.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises an apparatus that satisfies the need for increased refrigeration capacity, and increased dehumidification in a two circuit evaporator when one circuit is inactive during part load operation. For the purpose of summarizing the invention, the integrated dual circuit evaporator system for vaporizing refrigerant passing through two separate thermal transfer cycle circuits comprise two independent evaporator circuits intertwined and integrated in such a way that air passing through said evaporator system when one circuit is inactive comes into contact with the active circuit across the entire surface of the evaporator thereby allowing for zero so-called bypass air. Furthermore, each evaporator circuit comprises first and second evaporator sections (or more) in serial communication with one another, positioned in such a way that the colder and then coldest sections are downstream in the direction of the air stream through the evaporator from the warmer section(s) of the evaporator. The evaporator sections themselves may be any of a variety such as flat, slant of "A" coil evaporators capable of being used in a dual circuit, dual (or multi) sectional evaporator system.

Simply, each circuit of a dual circuit evaporator is designed to occupy the full face area of a dual circuit evaporator leaving no area of so-called bypass air when one circuit is inactive and further designed so that the coldest refrigerant passing through the thermal transfer cycle flows through the second (or more) downstream evaporator section while the warmest refrigerant flows through the first or upstream evaporator section.

Moreover, these full face area designs for each circuit of a dual circuit evaporator comprise of several possible configurations including the use of an alternating diagonal circuit design where the refrigerant of each circuit and each distribution tube from the expansion device passes through each alternating distribution tube of each individual circuit on a path at a diagonal to the direction of air flow through the evaporator while maintaining the principle of warmest refrigerant in the front face of the evaporator and the coldest refrigerant on the rear face of the evaporator. An additional design would be to place one-half of one distribution tube fed circuit in front of the second one-half of a second circuit, the first one-half of this second distribution tub fed circuit in front of the second one-half of the first distribution tube fed circuit in front of the second one-half of the first distribution fed circuit again while maintaining the principle of temperature counter flow design.

Another important feature is that with both circuits active and the blower at full speed, the incorporation of temperature counter flow design into integrated dual circuit evaporator will provide for highest possible capacity and best dehumidification possible. Therefore, it can be seen that the present invention would be greatly appreciated even more so.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

With reference to the drawings and in particular to FIGS. 3, 3*a*, 4*a*, 4*b*, 4*c*, 5, 6, 6*a*, 6*b*, 6*c* and 6*d* thereof, a new and improved dual circuit evaporator system embodying the principles and concepts of the present invention and generally designated by the reference number 10 will be described. The dual circuit evaporator system of the present invention comprises circuiting one circuit of a dual circuit evaporator in such away as to prevent the possibility of bypass air when one circuit is inactive, wherein the circuit is designed to flow in each circuit on a diagonal to the direction of air flow or for the first one-half of the first circuit to be in front of the second one-half of the second circuit and the first one-half of the second circuit to be in front of the second one-half of the first circuit. Further, the dual circuit evaporator system incorporates the principle of temperature counter flow design and comprises circuiting each circuit of the dual circuit evaporator in such a way that the warmest sections are upstream of the air supply of the colder and the coldest sections of the evaporator circuits as prescribed in U.S. Pat. No. 6,116,048. The present invention may have various configurations comprising a variety of different types to include flat coil, A coil or slant coil, dual circuit and the like.

FIGS. 3, 3*a*, 4*a*, 4*b*, 4*c*, 5, 6, 6*a*, 6*b*,6*c* and 6*d* illustrate generally the preferred embodiment of the invention wherein each circuit of a dual circuit evaporator independently covers the entire face area of the evaporator coil and further in each circuit the warmest sections of the evaporator are located upstream in the air stream with subsequently colder sections of the evaporator located further and further downstream in the air stream as prescribed in U.S. Pat. No. 6,116,048.

Figure 1:
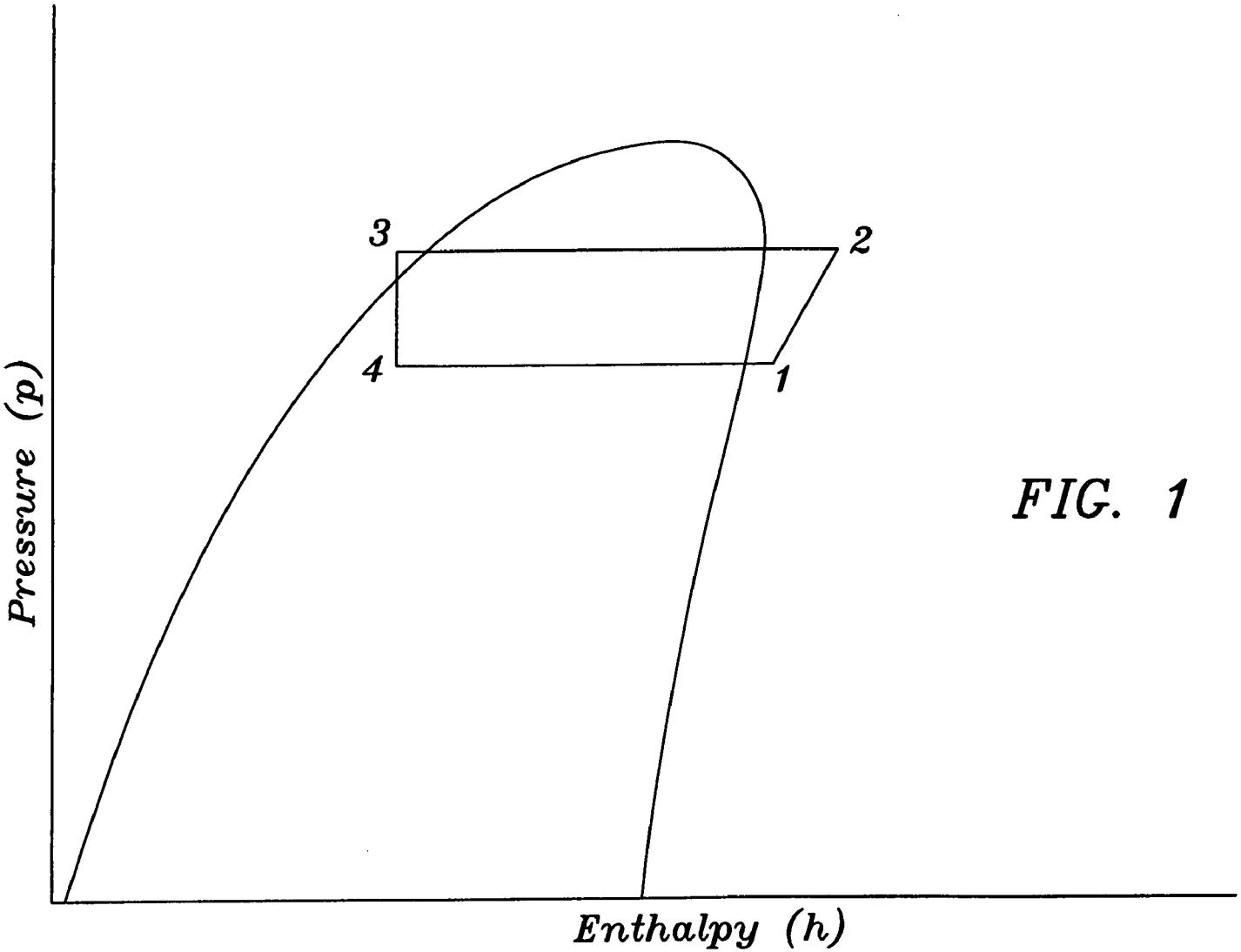
FIG. 1 is a pressure enthalpy (P/h) diagram illustration of the vapor compression refrigeration cycle.
Figure 1A:
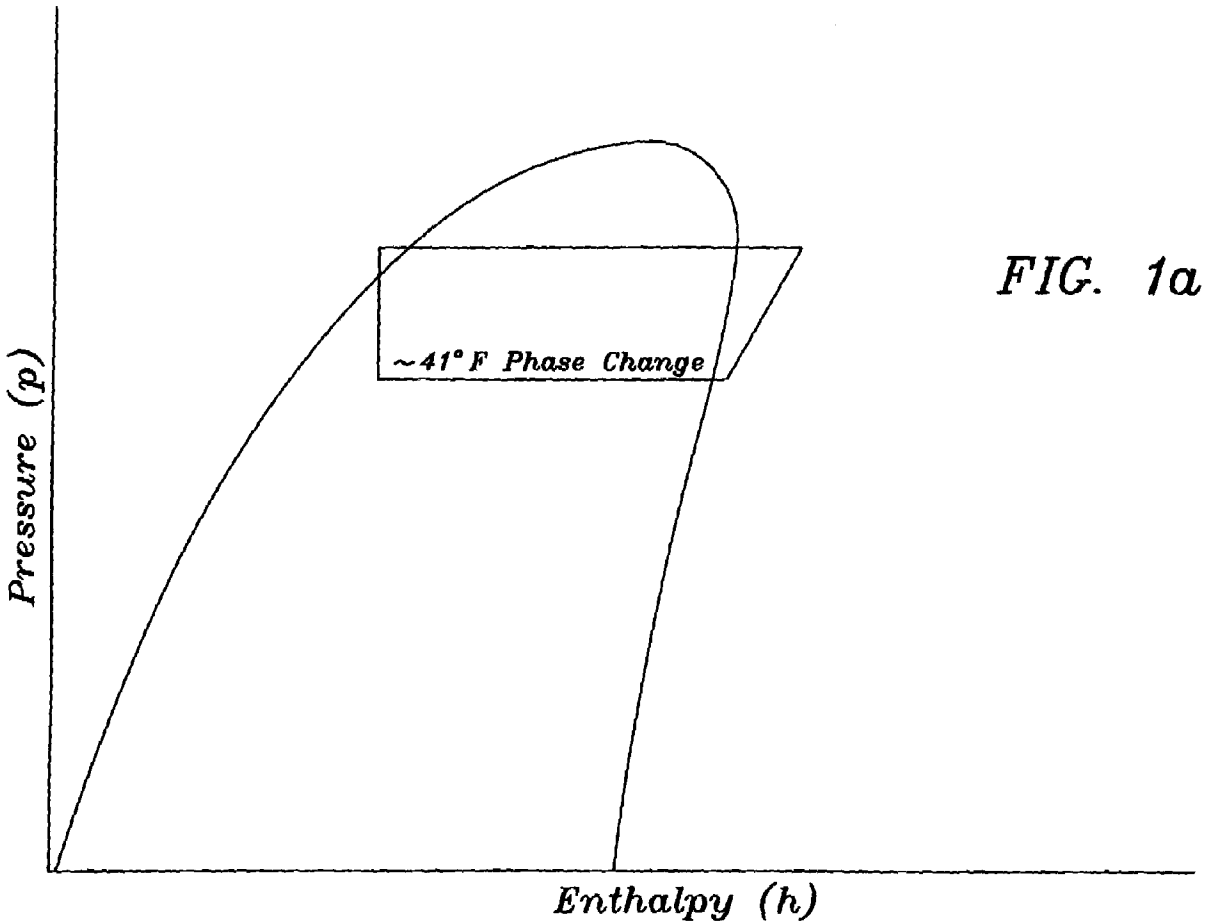
FIG. 1*a* is a P/h diagram showing the refrigeration cycle of a typical dual circuit evaporator with one circuit inactive, operating without the present invention.
Figure 1B:
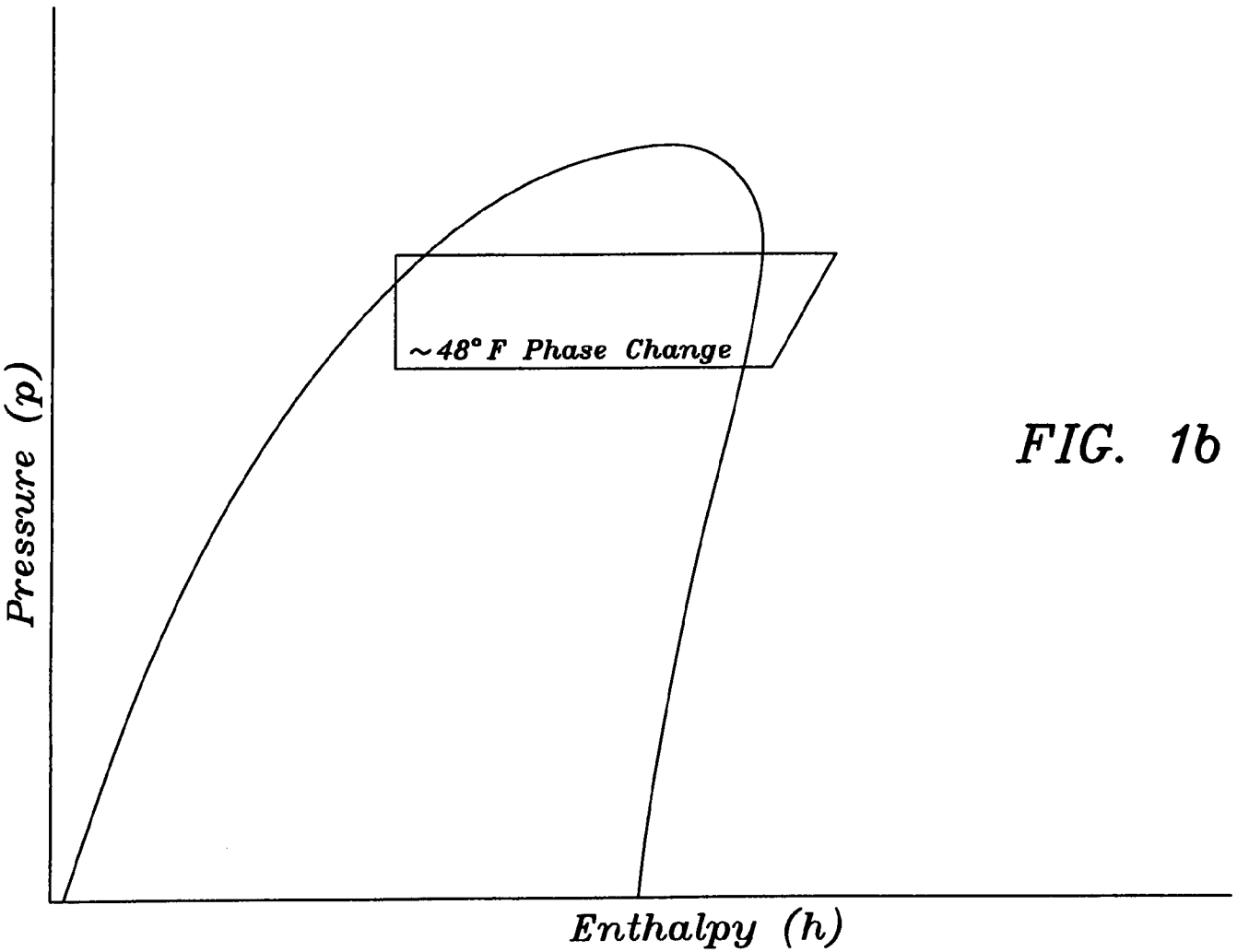
FIG. 1*b* is P/h diagram showing the refrigeration cycle of a typical dual circuit evaporator with one circuit inactive, operating with the present invention.
Figure 1C:
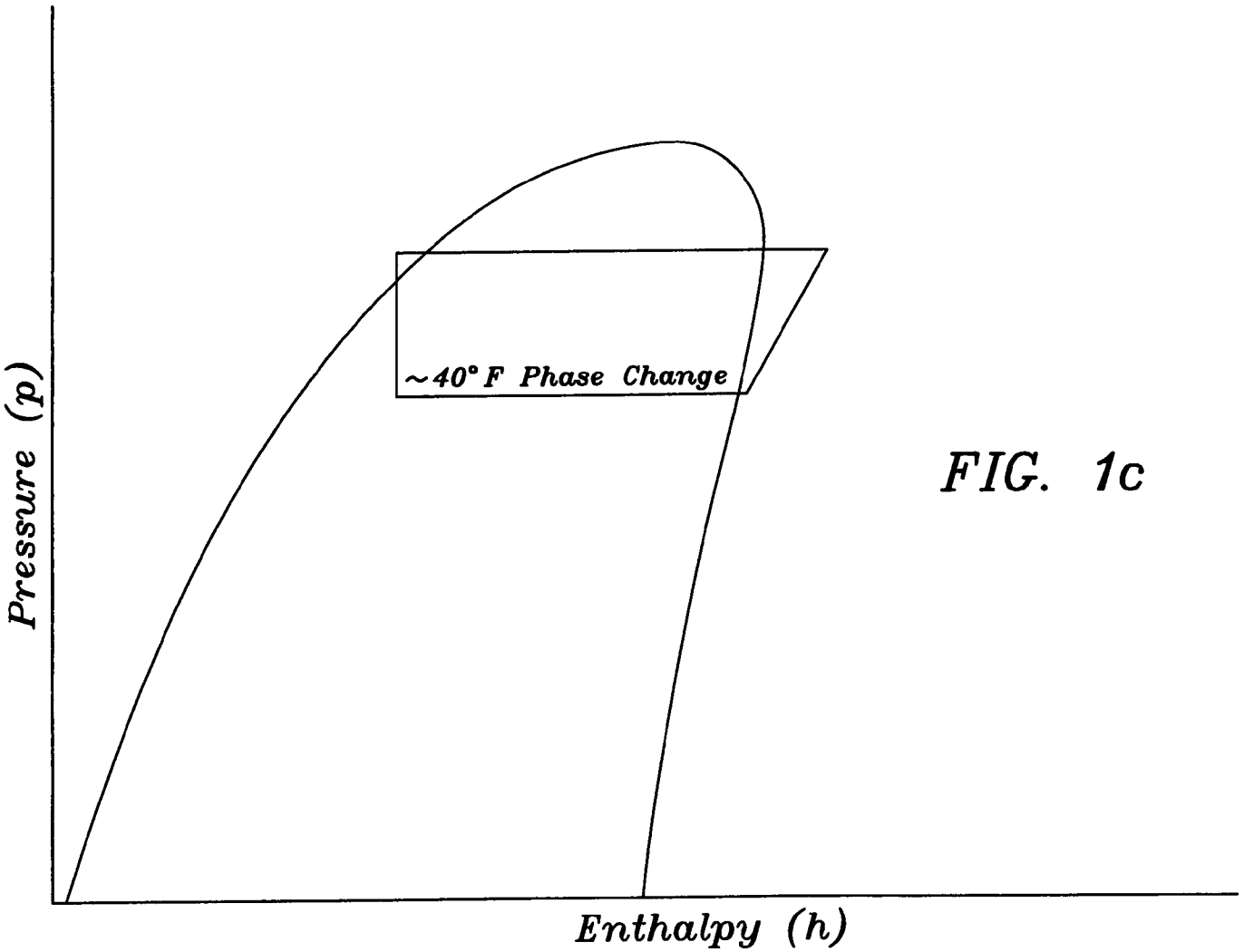
FIG. 1*c* is a P/h diagram showing the refrigeration cycle of a typical dual circuit evaporator with both circuits active, operating without the present invention.
Figure 1D:
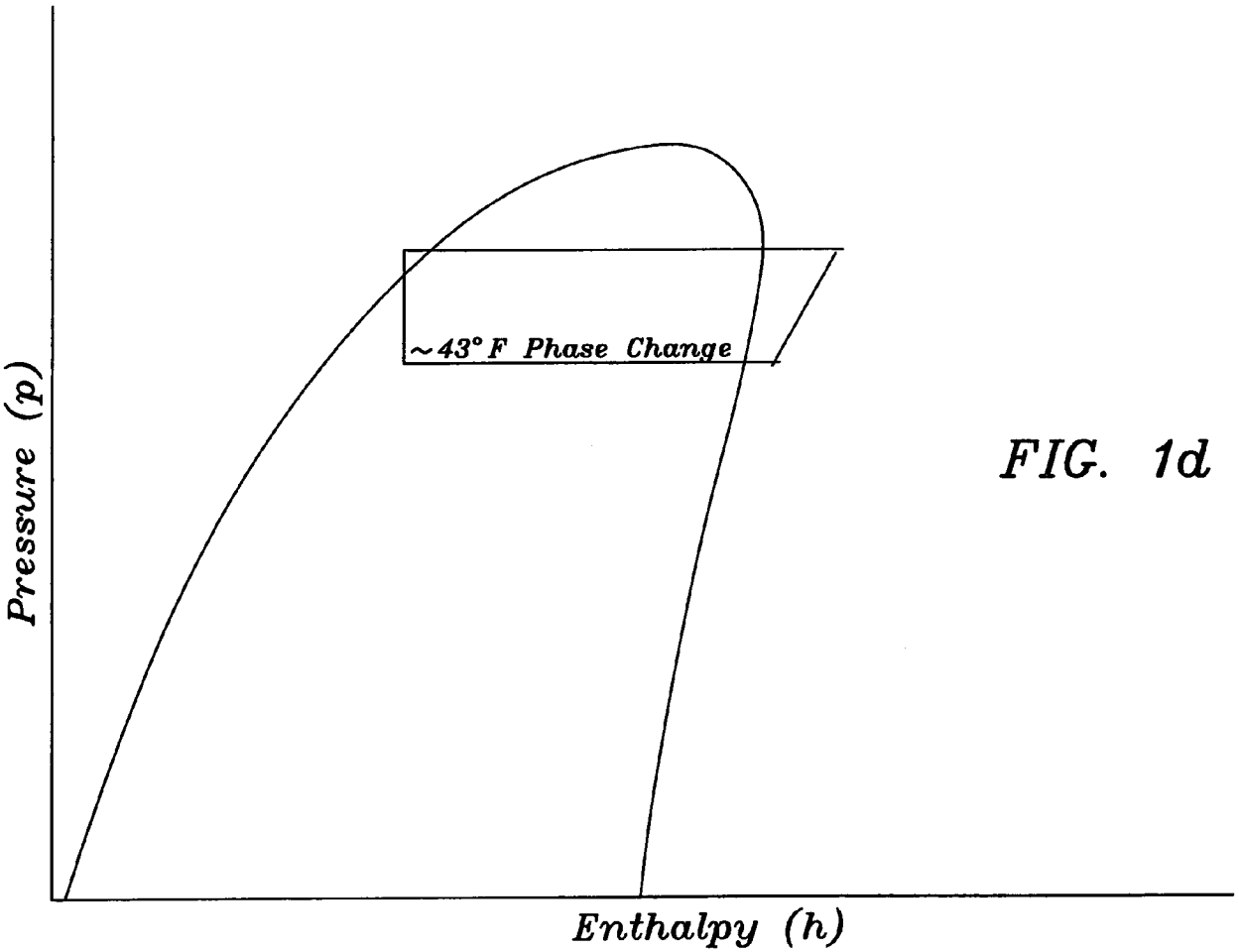
FIG. 1*d* is a P/h diagram showing the refrigeration cycle of a typical dual circuit evaporator with both circuits active, operating with the present invention.

FIGS. 1*a*, 1*b*, 1*c*, and 1*d* illustrate the refrigeration cycle of one circuit of dual circuit evaporator system for: one circuit inactive without the present invention (FIG. 1*a*); one circuit inactive with the present invention (FIG. 1*b*); both circuits active operating without the present invention (FIG. 1*c*); both circuits active operating with the present invention (FIG. 1*d*).

Figure 2:
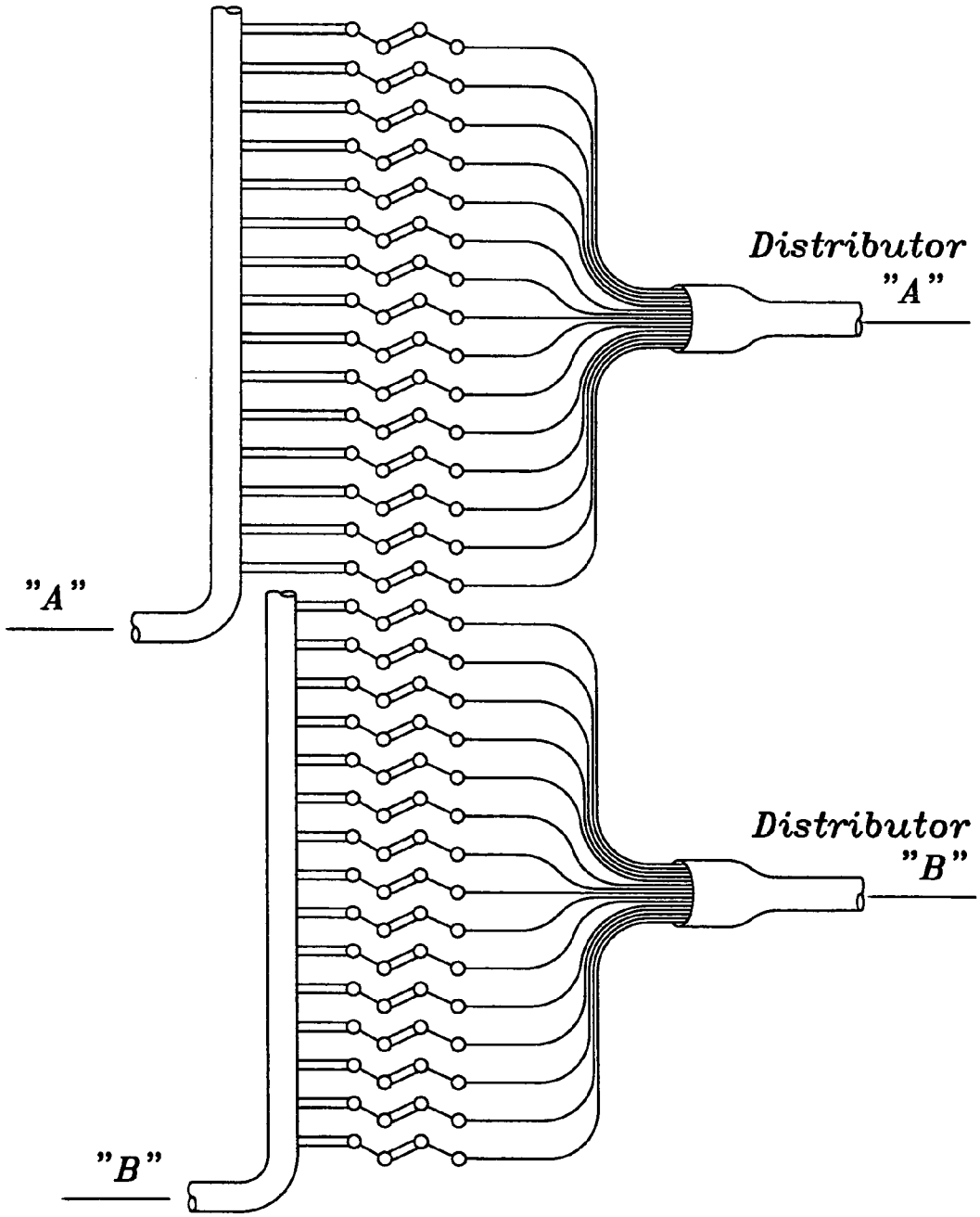
FIG. 2 is an illustration of a typical or standard split face, (horizontally split) dual circuit evaporator. (Circuit A located above Circuit B).
Figure 2A:
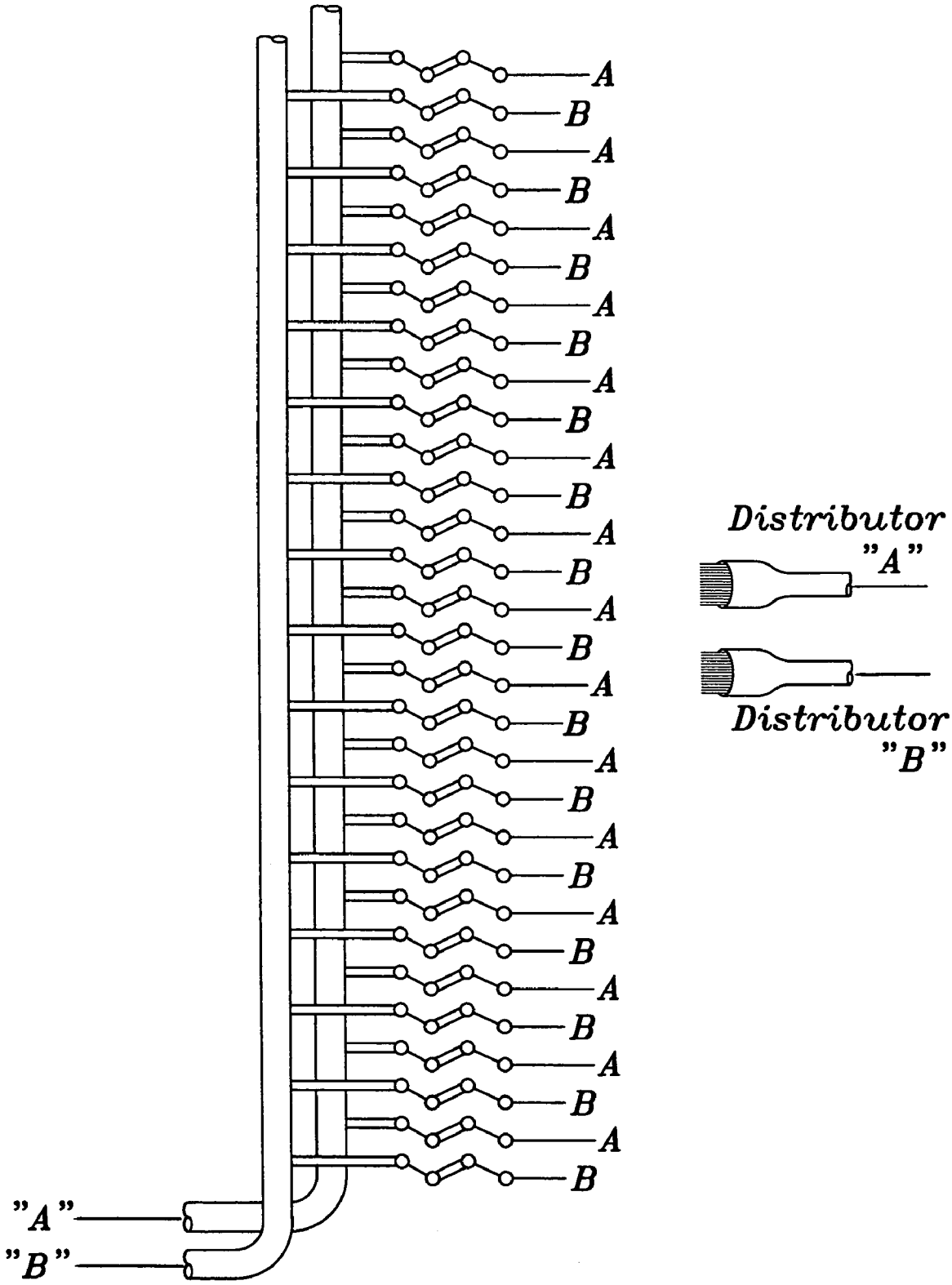
FIG. 2*a* is an illustration of a typical or standard alternating circuit dual circuit evaporator.
Figure 2B:
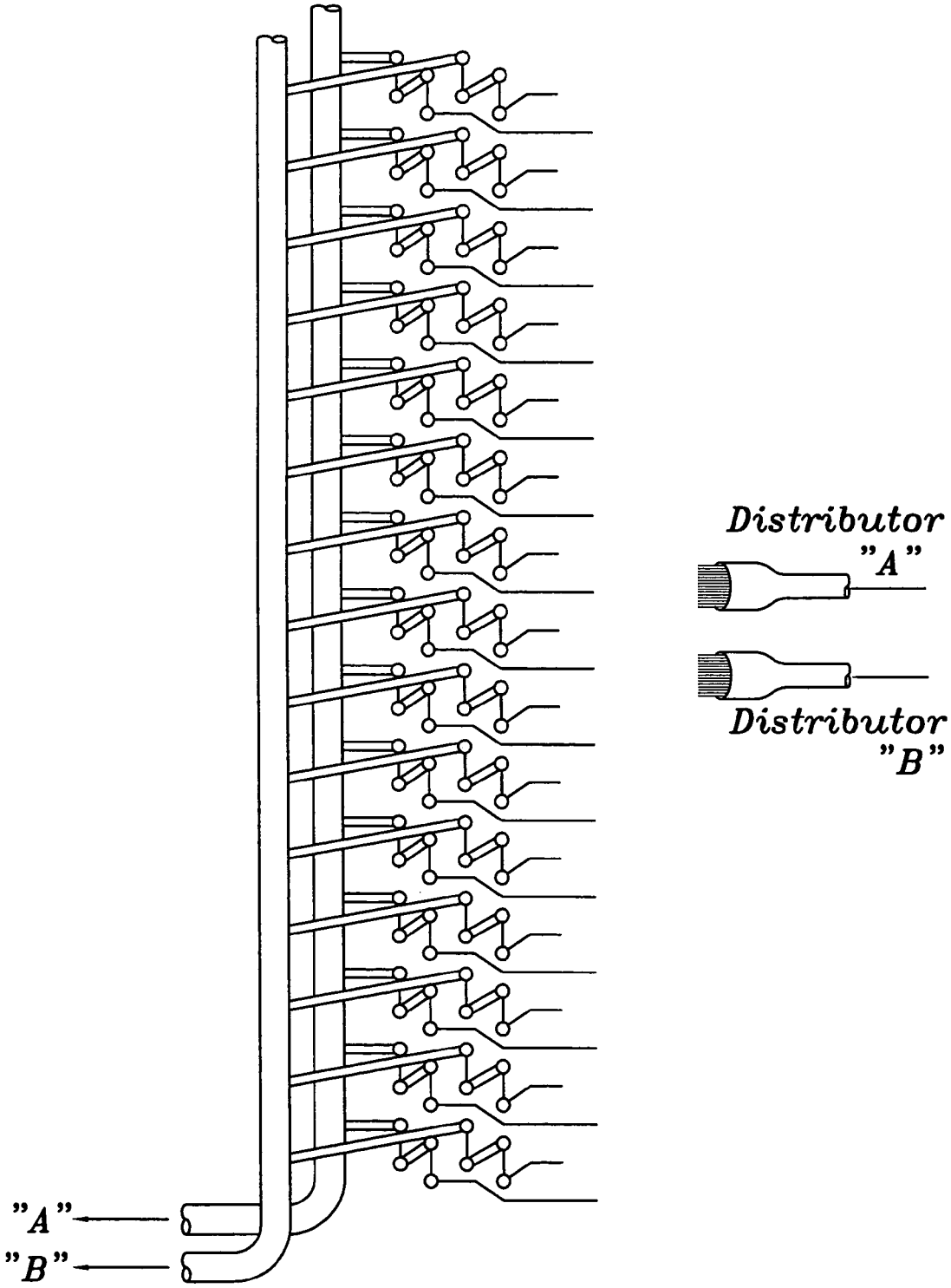
FIG. 2*b* is an illustration of a typical or standard (vertically split) dual circuit evaporator. (Circuit A located in front of Circuit B).

FIGS. 2, 2*a*, and 2*b* illustrate the prior art dual circuit evaporators, known in the industry wherein either bypass air situations are created, where air passing though the evaporator does not come into contact with an active refrigeration circuit, as illustrated in FIGS. 2 and 2*a*, or the two circuits act at different capabilities and efficiencies when both circuits are active as illustrated in FIG. 2*b*. As shown in FIGS. 2 and 2*a*, when one circuit is inactive (example: no refrigerant mass flow through circuit B), then airflow passing through the evaporator section of the B circuit illustrated in FIG. 2, or through the B circuit illustrated in FIG. 2*a*, experiences no heat gain or loss, only a resistance to air flow created by the passage of the air through the coil. As shown in FIG. 2*c* when both circuits are active, the front section (Circuit A) cools/precooks the air that passes into (Circuit B) causing the two circuits to act at different evaporator temperatures thereby acting at different capacities and efficiencies. Specifically, Circuit B acts at a lower capacity and efficiency than that of Circuit A.

Figure 3:
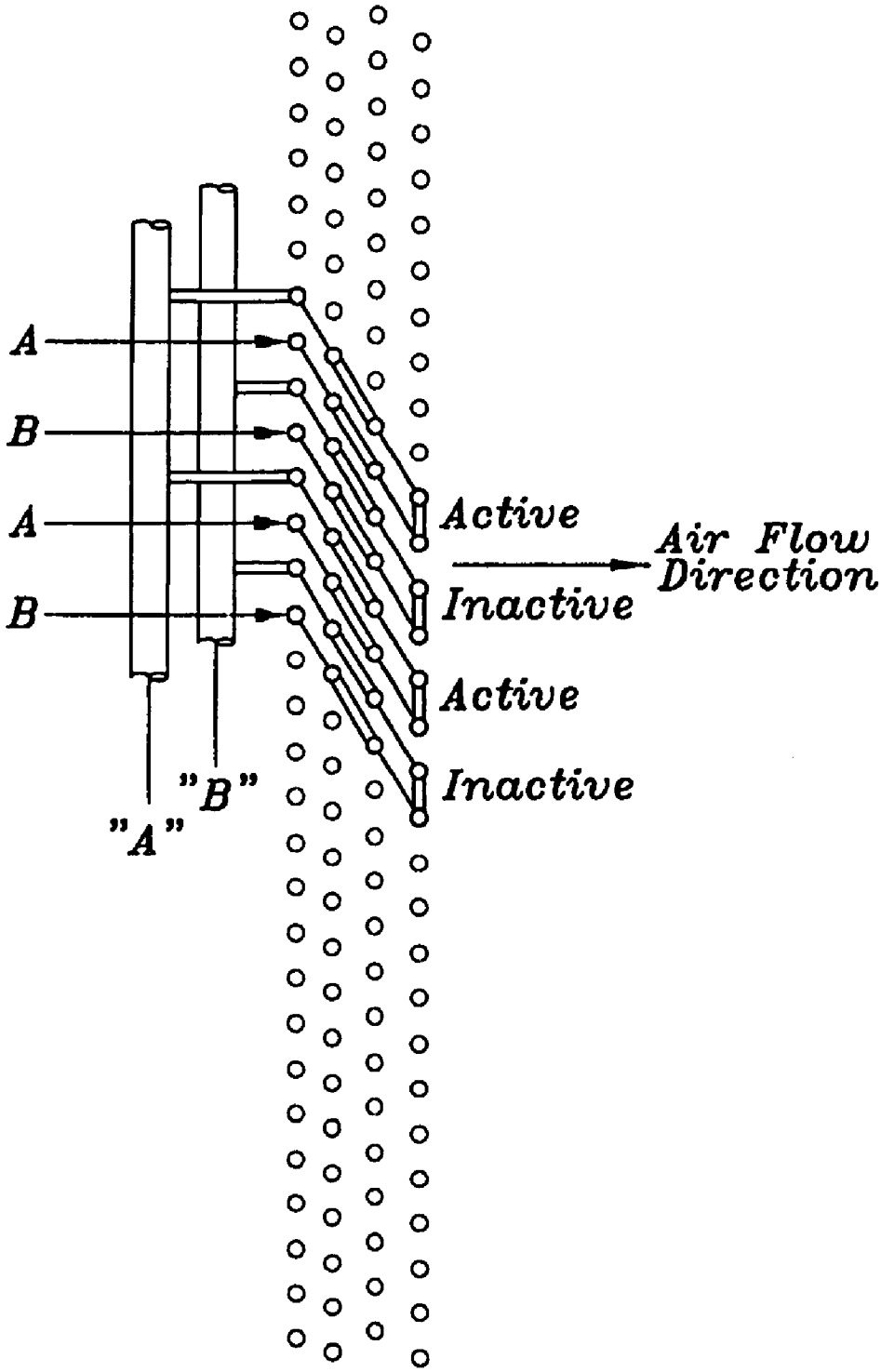
FIG. 3 is an illustration of one form of a diagonal alternating circuit dual circuit evaporator utilizing the principles of temperature counter flow design showing how this eliminates bypass air.
Figure 3A:
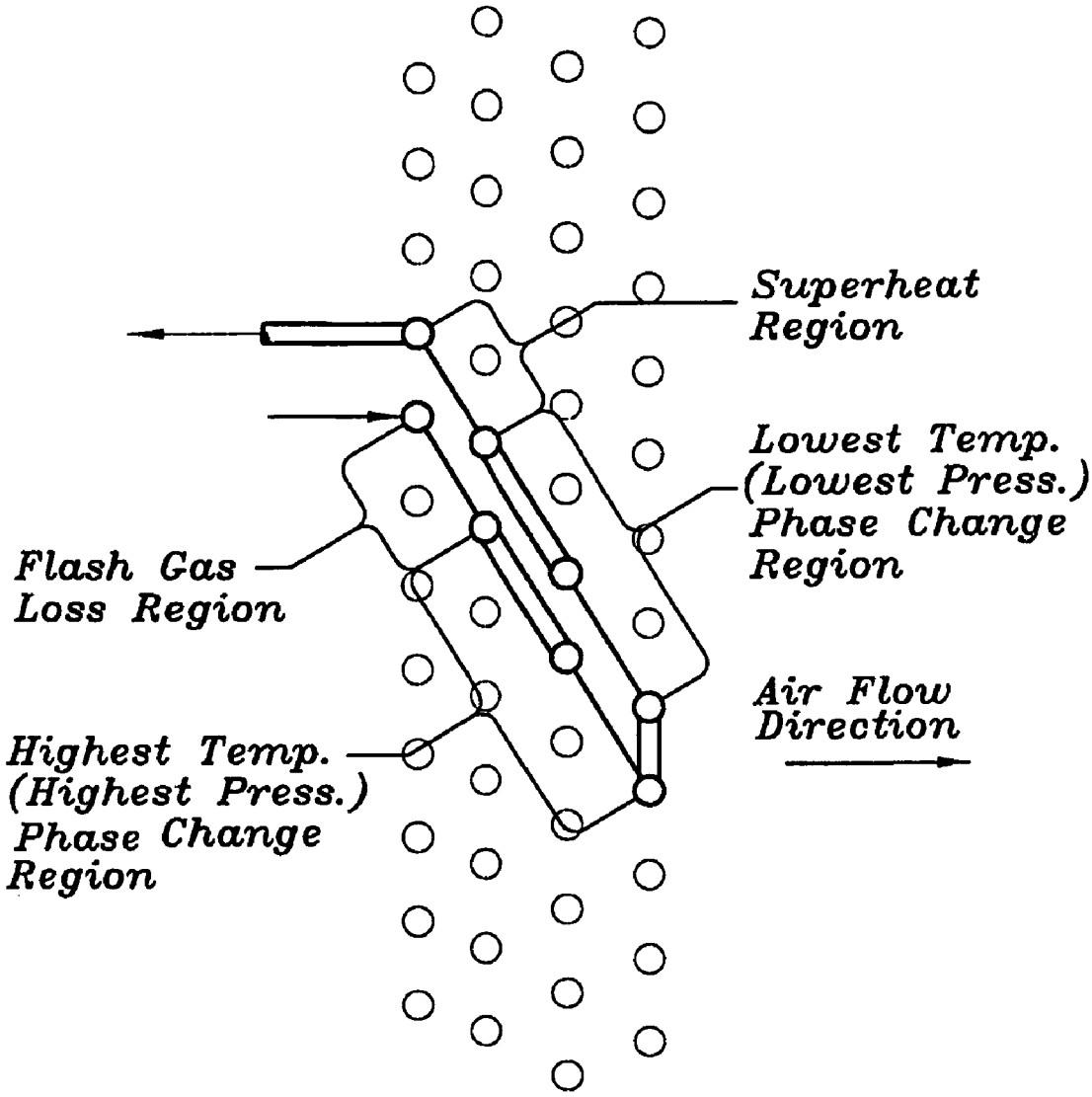
FIG. 3*a* is a one distribution tube illustration of a circuit of a diagonal circuit dual circuit evaporator utilizing the principle of temperature counter flow design showing the temperature gradient through the individual circuit.
Figure 3B:
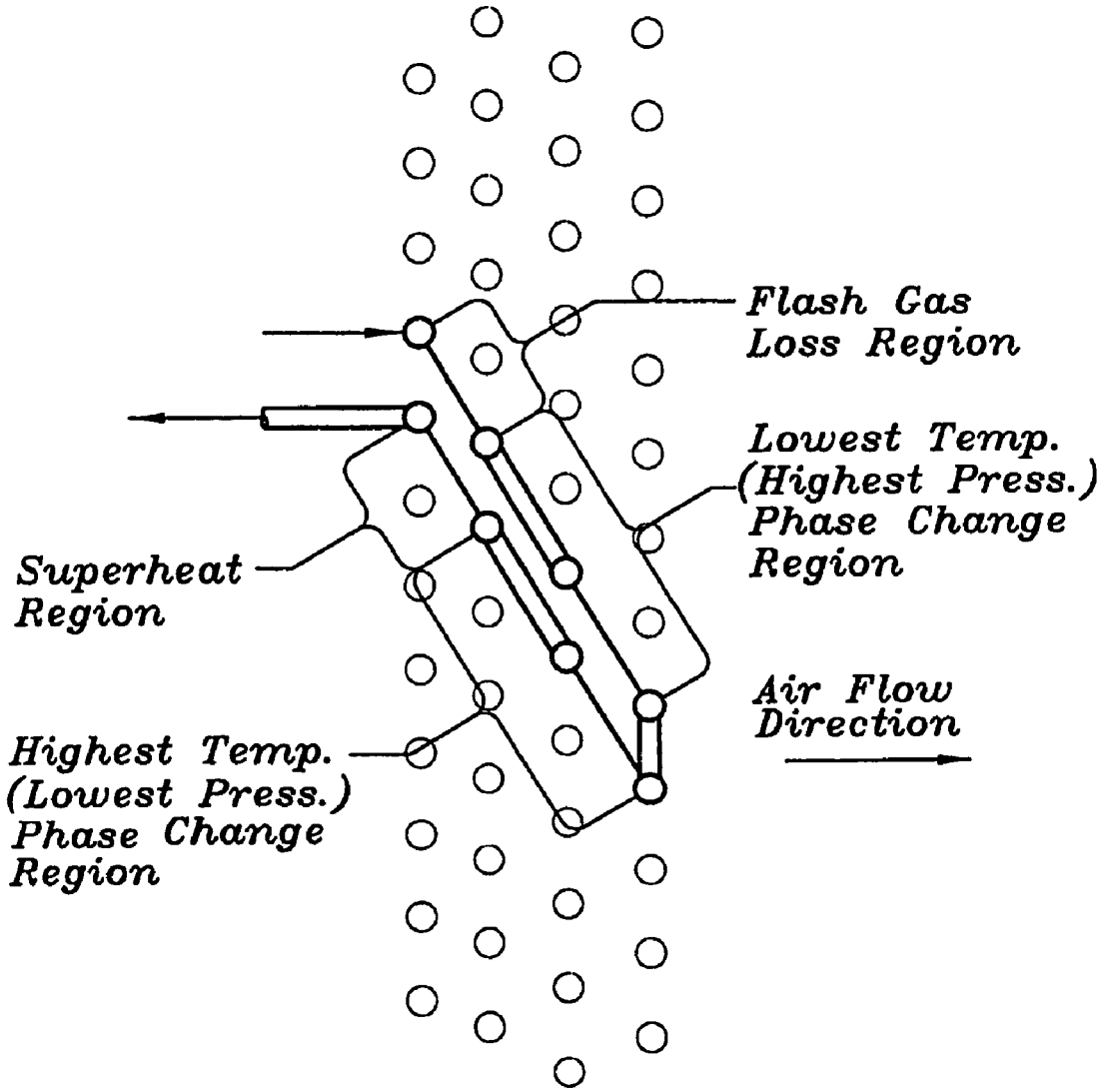
Figure 5:
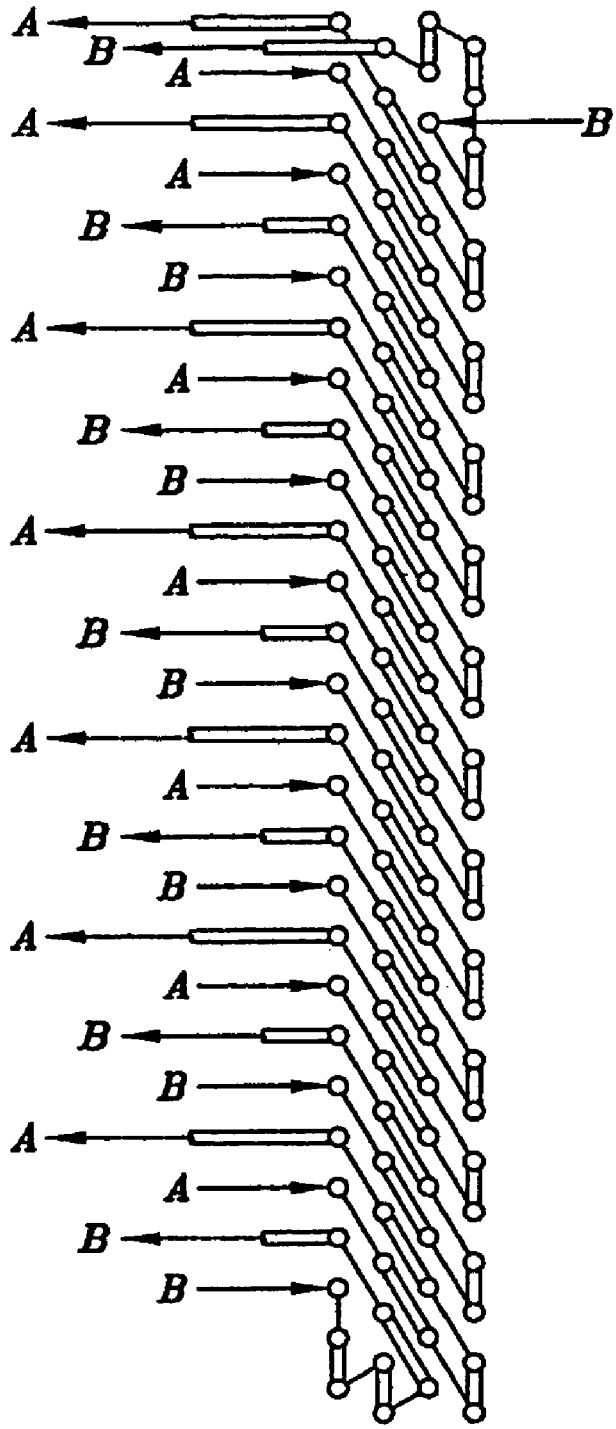
FIG. 5 is an illustration of the preferred embodiment of a flat coil utilizing the diagonal alternating circuit evaporator.
Figure 6:
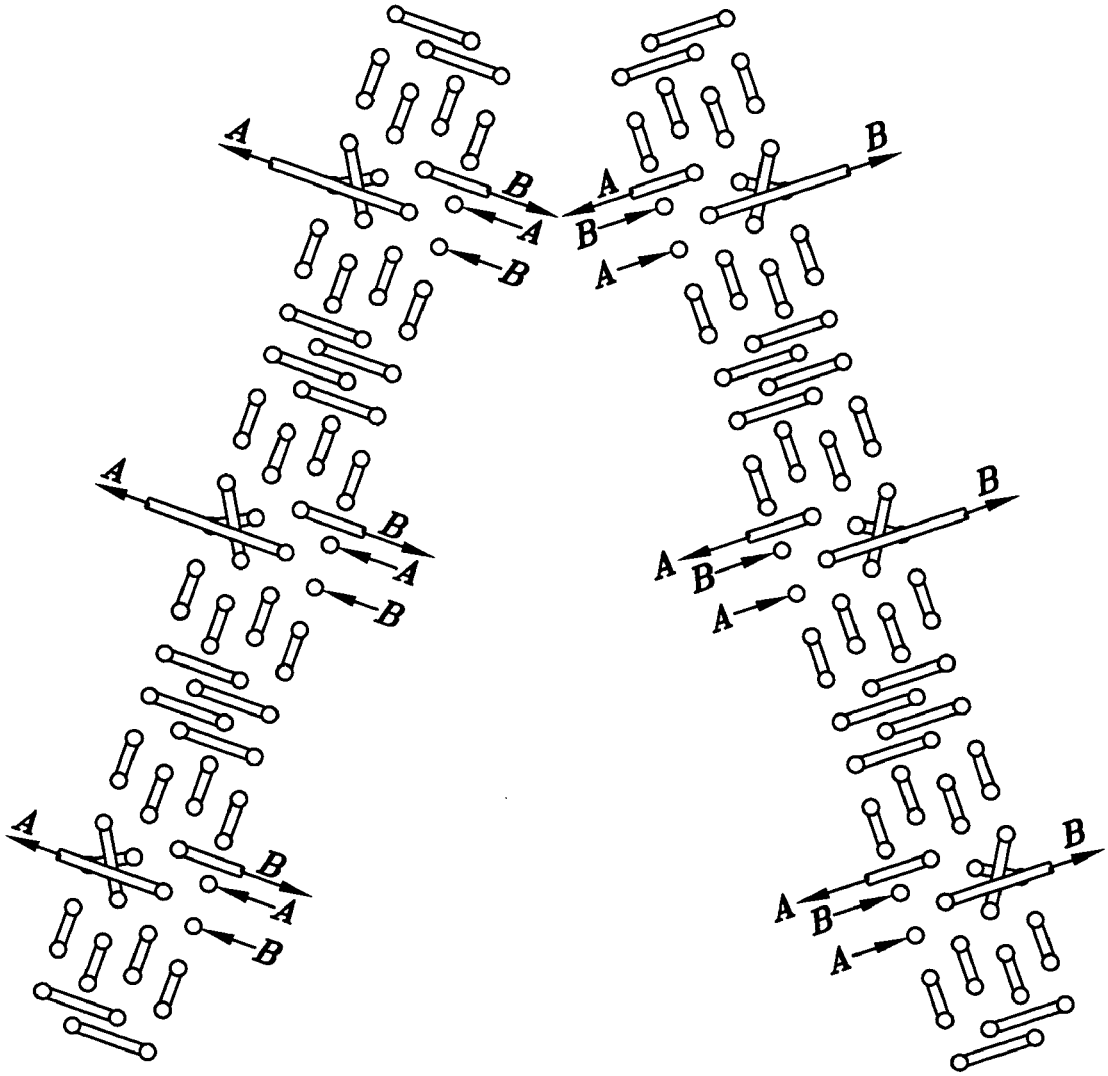
FIG. 6 is an illustration of the preferred embodiment of an "A" coil utilizing one-half of one circuit alternating with one-half of the second circuit of a dual circuit evaporator.
Figure 6A:
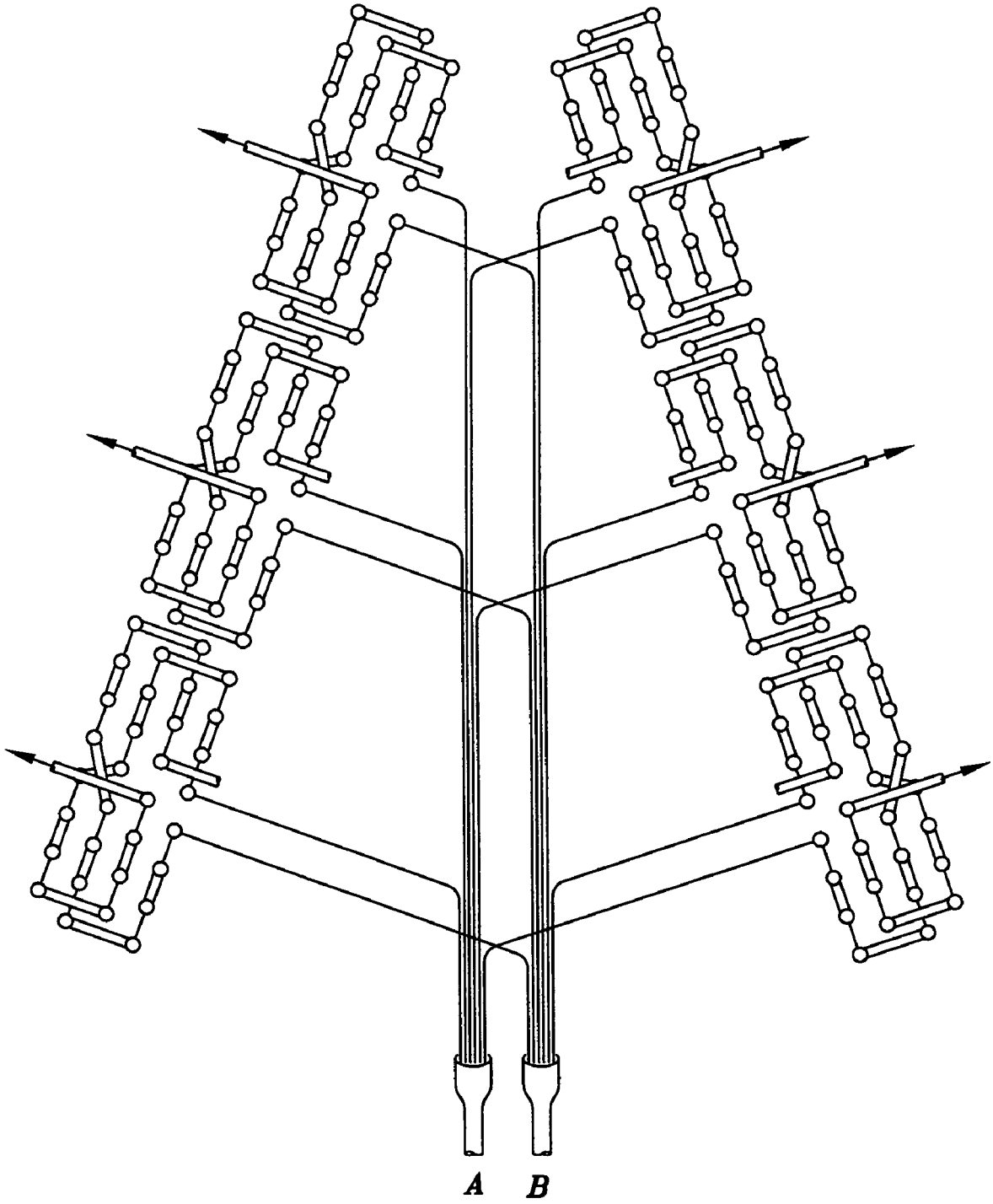
FIG. 6*a* is an illustration of the preferred embodiment of an "A" coil utilizing the integrated dual circuit design of the present invention showing the capillary tube manifold connections.
Figure 6B:
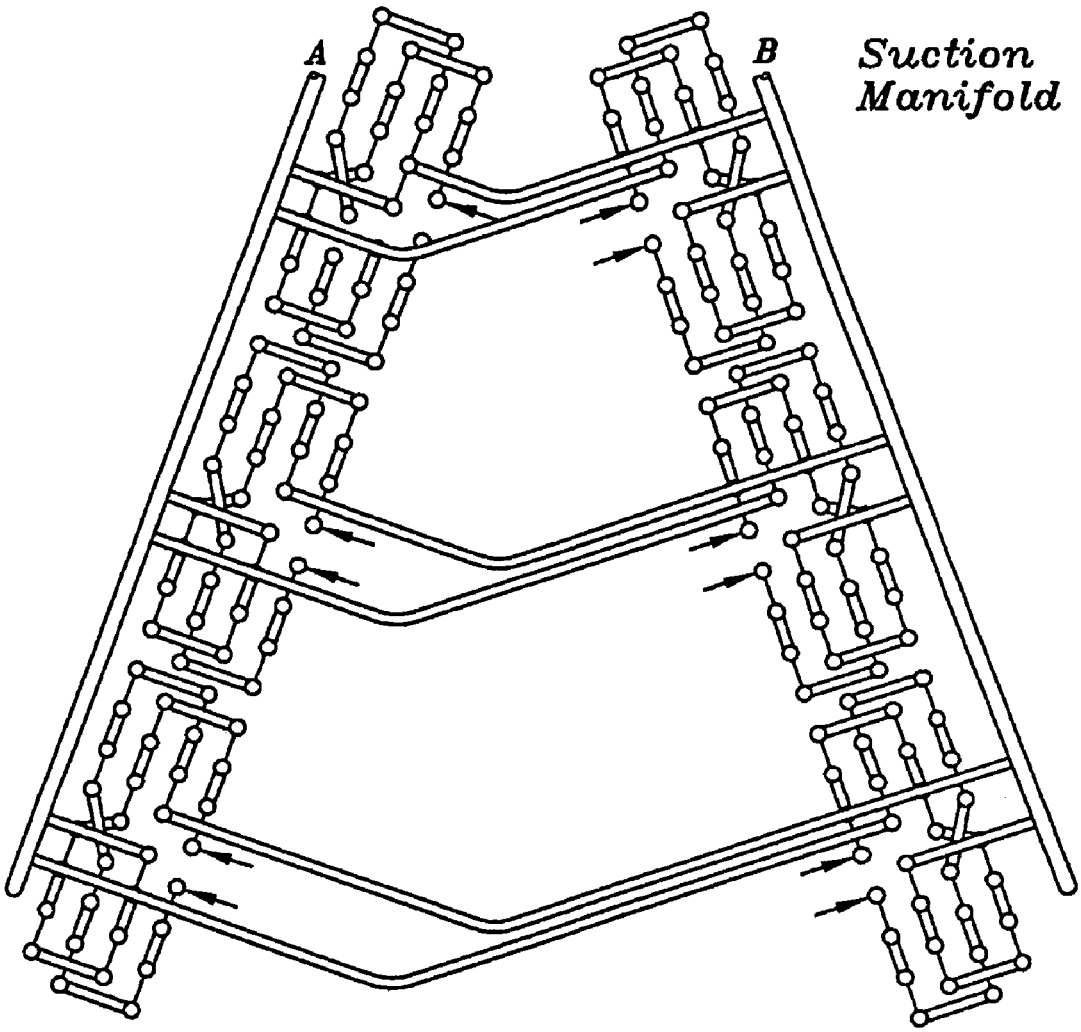
FIG. 6*b* is an illustration of the preferred embodiment of an "A" coil utilizing the integrated dual circuit design of the present invention showing the suction line manifold connections.
Figure 6C:
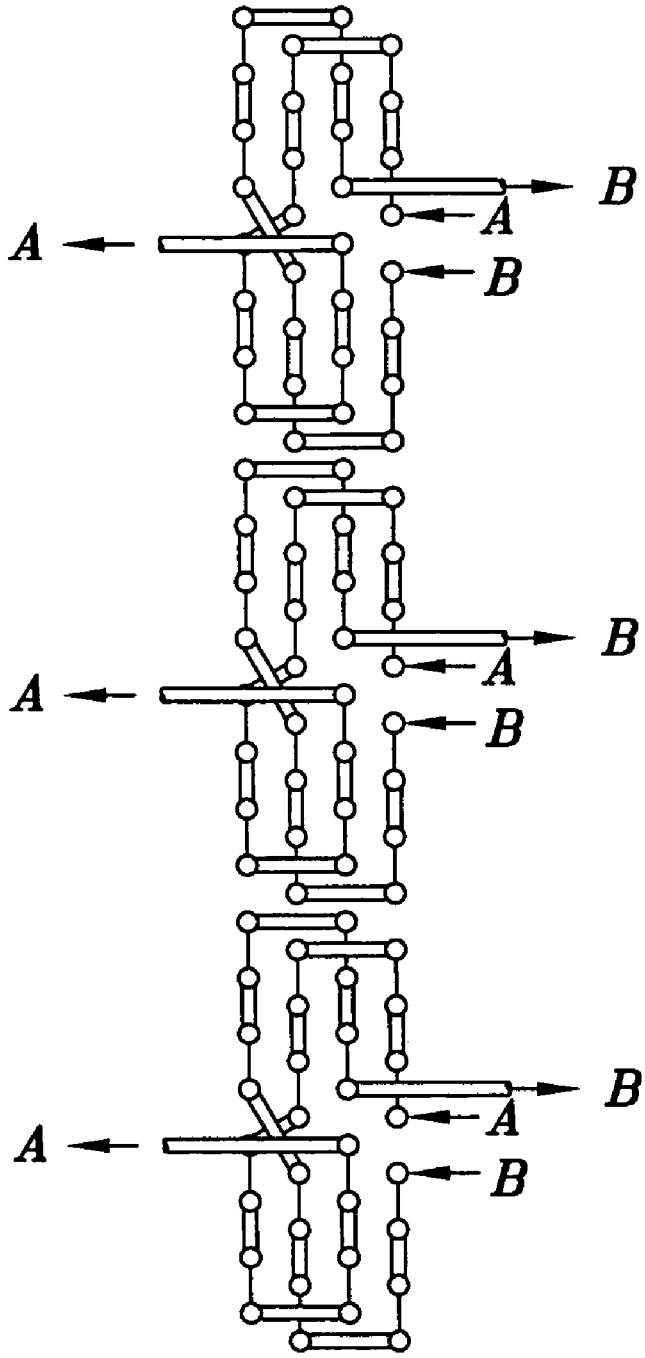
FIG. 6*c* is an illustration of the preferred embodiment of an "A" coil utilizing the integrated dual circuit design of the present invention showing the "left" side slab coil design.
Figure 6D:
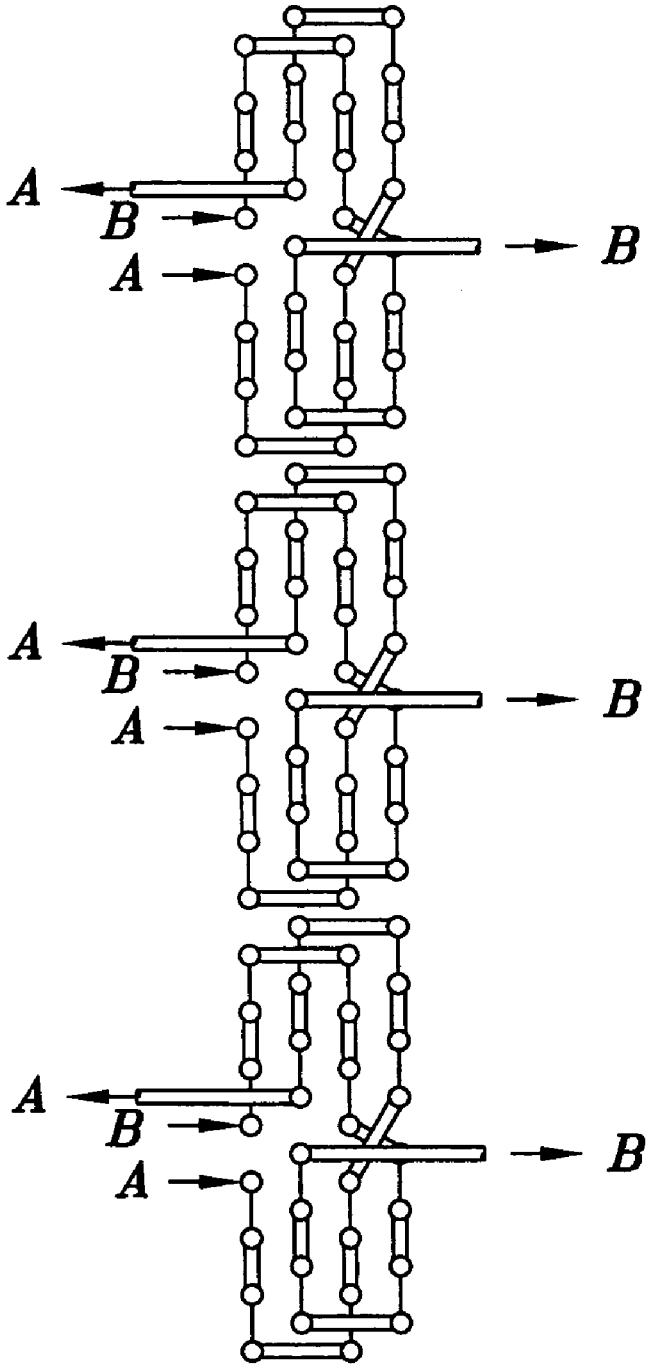
FIG. 6*d* is an illustration of the preferred embodiment of an "A" coil utilizing the integrated dual circuit design of the present invention showing the "right" side slab coil design.

FIGS. 3, 3*a* and 5 illustrate one form of the preferred arrangement of the present invention wherein a two circuit evaporator has alternating circuits piped in a diagonal circuiting direction to that of the airflow direction and circuited to provide counter flow heat exchange temperatures to the direction of the airflow as prescribed in U.S. Pat. No. 6,116,048. By the alternating circuits being on a diagonal to the airflow direction, if one circuit is inactive (FIG. 3), the air passing through the coil does not fail to come into contact with some portion of the active circuit.

FIG. 3 illustrates the airflow through the alternating circuits when one circuit is inactive.

FIG. 3*a* illustrates the temperature gradients of the refrigerant showing the warmest region in front of colder regions in front of the coldest regions. Note that the arrangement would be different for refrigerants with a high glide characteristic.

FIGS. 4*a*, 4*b*, 4*c*, 6, 6*a*, 6*b*, 6*c* and 6*d* illustrate another form of the preferred arrangement of the present invention wherein a two circuit evaporator has integrated circuits piped in an intertwining manner and circuited to provide counter flow heat exchange temperatures to the direction airflow as prescribed in U.S. Pat. No. 6,116,048. By the two circuits being intertwined, when one circuit is active (FIG. 4*a*), the air passing through the coil does not fail to come into contact with some portion of the active circuit.

Figures 4A, 4B, 4C:
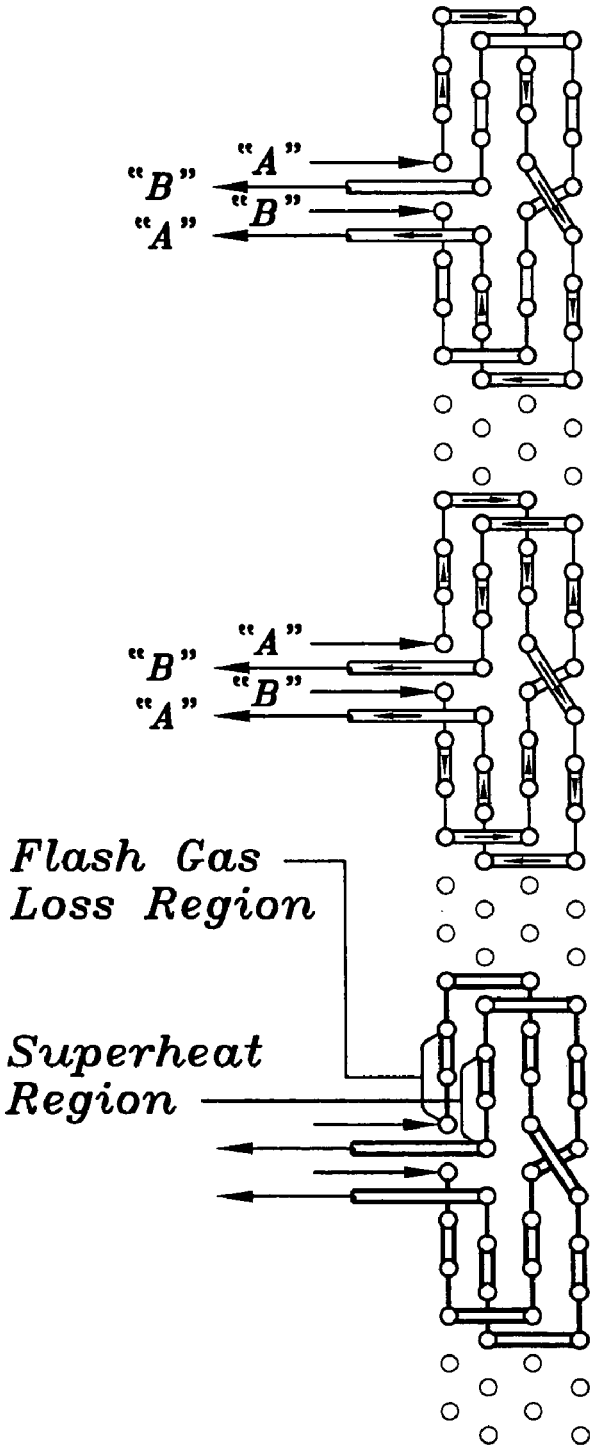
FIG. 4*a* is illustrative of one circuit integrated with the second circuit of a dual circuit evaporator utilizing the principle of temperature counter flow design showing how this eliminates bypass air when one circuit is inactive.
FIG. 4*b* is illustrative of one circuit integrated with the second circuit of a dual circuit evaporator utilizing the principle of temperature counterflow design, showing the airflow through the coil when both circuits are active.
FIG. 4*c* is an illustration of open section of an integrated dual circuit evaporator utilizing the principle of temperature counter flow design showing the temperature gradient through the individual circuits.

FIG. 4*a* illustrates the airflow through the intertwined circuits when one circuit is inactive.

FIG. 4*b* illustrates the airflow through the intertwined circuits when both circuits are active.

FIG. 4*c* illustrates the temperature gradients of the refrigerant showing warmest regions (flash gas loss and superheat) upstream of the highest pressure (cold) phase change region which is in turn upstream of the lowest pressure (coldest) phase change region.

FIG. 5 is an illustration of an entire flat coil design in the preferred manner.

FIGS. 6, 6*a*, 6*b*, 6*c* and 6*d* illustrate the design of an entire A coil utilizing the preferred arrangement of the present invention utilizing the integrated intertwining circuits method.

When one circuit of a dual circuit evaporator of one of the prior art designs is inactive, the portion of air going through the active region is being cooled and dehumidified. The portion passing through the inactive region does not experience any heat transfer or change in condition. The air temperature passing through the active region cools a it passes through successive rows of tubing carrying the evaporating refrigerant. The problem is, that by having many rows of refrigerant versus half as many rows but twice the face area, the heat exchange efficiency decreases as the air temperature approaches the phase change temperature of the refrigerant, since the heat transfer rate is directional proportional to the difference in temperature. By cooling eh enter volume of air passing through an evaporator face area instead of cooling one half or some other fraction of the air supply then mixing with the non-cooled one half, a much more efficient refrigeration effect can be accomplished region part load operation because the mass flow of refrigerant will be higher due to a higher phase change temperature of the refrigeration. Increased phase change temperature is proportional to an increased mass flow of refrigerant produced by compressor per compressor power consumption and thereby proportional to increased compressor efficiency. FIG. 1*a* represents the refrigeration system operating with one circuit of a previously known prior art circuit evaporator (FIGS. 2 and 2) inactive. FIG. 1*b* represents the refrigeration cycle of a refrigeration system with all components identical to the first refrigeration except the use of an evaporator design embodying the principles and concepts of the present invention as illustrated in FIGS. 3, 3*a*, 4, 4*a*, 4*b*, 6, 6*a*, 6*g*, 6*c* and 6*d* where one circuit is inactive and the operating conditions of air temperatures into the evaporator and condenser are identical to the conditions of those experienced by the system represented in FIG. 1*a*.

These representations as illustrated by the refrigerant conditions plotted on the pressure enthalpy diagrams of FIGS. 1*a* and 1*b* are based on data taken in actual laboratory testing. The phase change temperature in the evaporator section of the system using the previously known prior art type dual circuit evaporator where one circuit is inactive was 41 degrees Fahrenheit (FIG. 1*a*) while the phase change temperature in the evaporator section of the system suing eth dual circuit evaporator design embodying the principles and concepts of the present invention where one circuit is inactive was 48 degrees Fahrenheit (FIG. 1*b*) when run at identical entering air conditions to those of the system illustrated by the refrigeration cycle shown in FIG. 1*a*.

The same compressors as well as all other components except the evaporator were used in both test runs and the capacity of the system using the evaporator embodying the principles and methods of the present invention was 15 to 16% greater than that of the evaporator utilizing previously known prior art design methods and principles. This correlates exactly to the increase in mass flow seen in the compressor performance tables for the respective phase change temperatures.

When both circuits are active (FIGS. 1*c* and 1*d*), the difference in evaporator phase change temperatures is not as high and is due only to the effect generated by the improvements in evaporator design as prescribed in U.S. Pat. No. 6,116,048.

It can be seen that a significant improvement in part load performance of a dual circuit air conditioning or refrigeration system when one circuit is inactive can be attained by using a dual circuit evaporator that incorporates the principles and concepts of the present invention.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A refrigeration dual circuit evaporator comprising:

two main circuits, each containing a plurality of individual circuits that, when viewed in cross section, overlap one another in the direction of air flow through the evaporator, said plurality of individual circuits of each main circuit being connected together with a common distributor, and said two main circuits being arranged within said evaporator such that, when one main circuit is active, air flowing through the evaporator contacts a portion of the active main circuit across the entire face of the evaporator, wherein each individual circuit has a flash gas loss region, a highest temperature phase change region, a lowest temperature phase change region, and a superheat region located in series, and the circuit is structured such that air flow through the evaporator exits said flash gas loss region before exiting said highest temperature phase change region, exits said superheat region before exiting said lowest temperature phase change region, and at least a portion of the air flow passing through said flash gas loss region passes through at least one of said superheat region and a superheat region of another of said individual circuits.

2. A refrigeration dual circuit evaporator comprising:

two main circuits, each containing a plurality of individual circuits that, when viewed in cross section, are arranged completely diagonally with respect to the direction of air flow through the evaporator, said plurality of individual circuits of each main circuit being connected together with a common distributor, and said two main circuits being arranged within said evaporator such that, when one main circuit is active, air flowing through the evaporator contacts a portion of the active main circuit across the entire face of the evaporator, wherein each individual circuit has a flash gas loss region, a highest temperature phase change region, a lowest temperature phase change region, and a superheat region located in series, and the circuit is structured such that air flow through the evaporator exits said flash gas loss region before exiting said highest temperature phase change region, exits said superheat region before exiting said lowest temperature phase change region, and at least a portion of the air flow passing through said flash gas loss region passes through at least one of said superheat region and a superheat region of another of said individual circuits.

3. A refrigeration dual circuit evaporator comprising:

two main circuits, each containing a plurality of individual circuits, each individual circuit overlapping another said individual circuit from another of said main circuits in the direction of airflow through the evaporator, said plurality of individual circuits of each main circuit being connected together with a common distributor such that the input and output of each main circuit are arranged on the air flow upstream side of the compressor, and said two main circuits being arranged within said evaporator such that, when one main circuit is active, air flowing through the evaporator contacts a portion of the active main circuit across the entire face of the evaporator, wherein each individual circuit has a flash gas loss region, a highest temperature phase change region, a lowest temperature phase change region, and a superheat region located in series, and the circuit is structured such that air flow through the evaporator exits said flash gas loss region before exiting said highest temperature phase change region, exits said superheat region before exiting said lowest temperature phase change region, and at least a portion of the air flow passing through said flash gas loss region passes through at least one of said superheat region and a superheat region of another of said individual circuits.

4. A heat pump dual circuit evaporator comprising:

two main circuits, each containing a plurality of individual circuits that, when viewed in cross section, overlap one another in the direction of air flow through the evaporator, said plurality of individual circuits of each main circuit being connected together with a common distributor, and said two main circuits being arranged within said evaporator such that, when one main circuit is active, air flowing through the evaporator contacts a portion of the active main circuit across the entire face of the evaporator, wherein each individual circuit has a flash gas loss region, a highest temperature phase change region, a lowest temperature phase change region, and a superheat region located in series, and the circuit is structured such that air flow through the evaporator exits said flash gas loss region before exiting said highest temperature phase change region, exits said superheat region before exiting said lowest temperature phase change region, and at least a portion of the air flow passing through said flash gas loss region passes through at least one of said superheat region and a superheat region of another of said individual circuits.

5. A heat pump dual circuit evaporator comprising:

two main circuits, each containing a plurality of individual circuits that, when viewed in cross section, are arranged completely diagonally with respect to the direction of air flow through the evaporator, said plurality of individual circuits of each main circuit being connected together with a common distributor, and said two main circuits being arranged within said evaporator such that, when one main circuit is active, air flowing through the evaporator contacts a portion of the active main circuit across the entire face of the evaporator, wherein each individual circuit has a flash gas loss region, a highest temperature phase change region, a lowest temperature phase change region, and a superheat region located in series, and the circuit is structured such that air flow through the evaporator exits said flash gas loss region before exiting said highest temperature phase change region, exits said superheat region before exiting said lowest temperature phase change region, and at least a portion of the air flow passing through said flash gas loss region passes through at least one of said superheat region and a superheat region of another of said individual circuits.

6. A heat pump dual circuit evaporator comprising:

two main circuits, each containing a plurality of individual circuits, each individual circuit overlapping another said individual circuit from another of said main circuits in the direction of airflow through the evaporator, said plurality of individual circuits of each main circuit being connected together with a common distributor such that the input and output of each main circuit are arranged on the air flow upstream side of the compressor, and said two main circuits being arranged within said evaporator such that, when one main circuit is active, air flowing through the evaporator contacts a portion of the active main circuit across the entire face of the evaporator, wherein each individual circuit has a flash gas loss region, a highest temperature phase change region, a lowest temperature phase change region, and a superheat region located in series, and the circuit is structured such that air flow through the evaporator exits said flash gas loss region before exiting said highest temperature phase change region, exits said superheat region before exiting said lowest temperature phase change region, and at least a portion of the air flow passing through said flash gas loss region passes through at least one of said superheat region and a superheat region of another of said individual circuits.

* * * * *